United States Patent [19]

Schmidt

[11] 3,940,056

[45] Feb. 24, 1976

[54] SELF-CLEANING CENTRIFUGE DRUM

[75] Inventor: Reinhard Schmidt, Oelde, Germany

[73] Assignee: Westfalia Separator AG, Oelde, Germany

[22] Filed: Feb. 27, 1974

[21] Appl. No.: 446,450

[30] Foreign Application Priority Data

Feb. 27, 1973 Germany ..... 2309647

[52] U.S. Cl. ..... 233/20 A

[51] Int. Cl.[2] ..... B04B 1/14

[58] Field of Search ..... 233/19 R, 19 A, 20 R, 20 A

[56] References Cited

UNITED STATES PATENTS

| | | | |
|---|---|---|---|
| 2,578,484 | 12/1951 | Nyrop | 233/20 A |
| 2,862,659 | 12/1958 | Nyrop | 233/20 A |
| 3,749,303 | 7/1973 | Hemfort | 233/20 A |

*Primary Examiner*—George H. Krizmanich
*Attorney, Agent, or Firm*—Burgess, Dinklage & Sprung

[57] ABSTRACT

A centrifugal separator having at least one sludge discharge passageway in the drum for emptying sludge from the separator, and a piston valve for the sludge discharge passageway which is held in the closed position by control fluid introduced into a piston valve closing chamber, and opened for discharge of sludge by discharging the control fluid through a release passageway outfitted with a release valve. To counteract the tendency of the drum to tilt when control fluid is discharged, due to uneven emptying of the control fluid from the control chamber, an annular chamber emptying into the release passage, is provided at a peripheral portion of the control chamber. Means such as a ring is interposed between the control chamber and the annular chamber. The ring serves to define a single annular passage or a plurality of circumferentially space passages, placing the control chamber and annular chamber in communication. The opening or openings throttle the flow of fluid from the control chamber to the annular chamber so that the control chamber emties evenly, with the level of control fluid in the closing chamber remaining concentric with the drum axis, during emptying of the control chamber. Thereby, the said tendency to tilt is counteracted.

7 Claims, 2 Drawing Figures

SELF-CLEANING CENTRIFUGE DRUM

BACKGROUND

Figure 1:
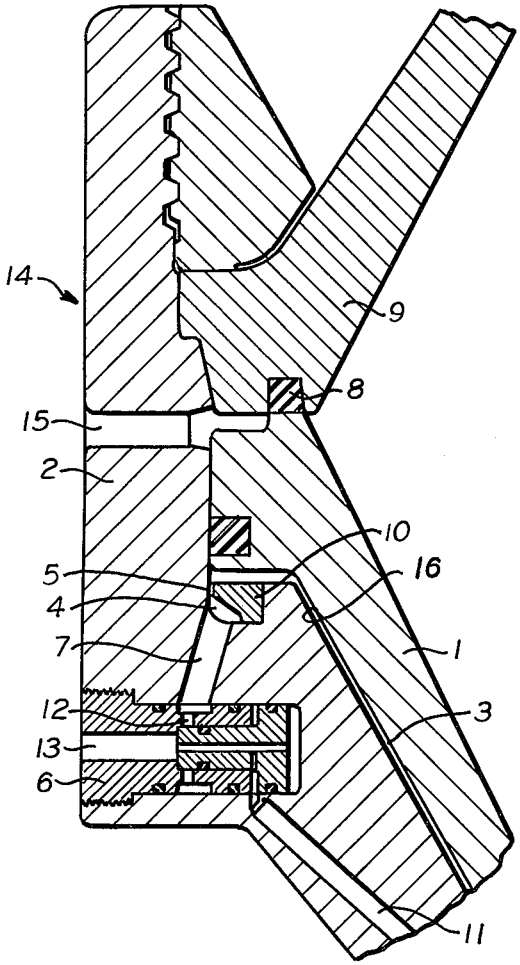

The invention relates to centrifugal separators, e.g., self-cleaning centrifugal separators having an axially displaceable piston or sliding valve which, upon the release of the control fluid from the closing chamber by means of an actuable release valve, is shifted to its open position under the pressure of the drum contents, thus uncovering an annular gap for the ejection of the solids. Such a drum is disclosed, for example, in German Pat. No. 2,041,371, and U.S. Pat. No. 3,754,701.

In drums of this kind a discharge or release passage leads from the radially outermost portion of the closing chamber to a release valve which, according to the position of the release valve body, connects this discharge passage to a passage leading out of the drum or separates it therefrom. Since experience shows that two or more valves cannot be operated synchronously, in general, only one release valve is provided.

After the emptying of the closing chamber has been initiated, it may happen that the slide valve will be tilted in its movement into the open position, which can be attributed only to the fact that the force acting on the sliding valve is not relieved uniformly over the entire circumference owing to the one-sided release of the closing fluid, i.e., that the free fluid level in the closing chamber will not retain its concentric shape. Upon the abrupt release of the discharge passage, which has a relatively large cross section, a flow gradient and hence a pressure gradient will develop from the point diametrically opposite the release passage to the release passage, so that the sliding valve is acted upon more strongly from the closing chamber in the area remote from the release valve than in the area adjacent the release valve, and consequently assumes a tilted position.

THE INVENTION

The invention is addressed to the problem of designing a centrifugal separator, e.g., a self-cleaning centrifugal separator, having only one release valve for the release of the closing fluid, so that the closing chamber will be uniformly emptied over its entire circumference and hence the force acting on the sliding valve from this side will be uniformly relieved.

This problem is solved by the invention in that, in the area of the greatest diameter of the closing chamber, the adjacent stationary drum portion (stationary as far as movement in the direction of the drum axis is concerned) is provided with an annular chamber, which communicates with the closing chamber and its radially outermost end through an annular passage or through a plurality of passages uniformly distributed over the circumference; the release passage, which leads to the release valve, communicates at its inlet end with said annular chamber; and the entrance cross section of said release passage is greater than the cross section of the annular passage or than the sum of the cross sections of the plurality of passages as the case may be.

Most simply, this annular chamber with the annular passage or plurality of passages leading to the closing chamber may be constituted by an appropriately shaped ring to be inserted into a groove in the stationary part of the drum.

With the sliding valve and the release valve in the closed position, the closing chamber, the annular chamber and the release passage, up to the release valve, are completely filled with control fluid. Desirably the construction is such that when the release valve is changed to its open position the control fluid discharges from the annular chamber disposed in the stationary drum portion, through the release passage and the release valve, more rapidly than it flows through the annular passage or the plurality of spaced passages from the closing chamber into the annular chamber.

Since the closing chamber empties over virtually its entire circumference, the concentric shape of the free fluid level is preserved even if, in case of the use of a plurality of planetary of connecting passages, the same amount of fluid is not discharged through each one.

Any pressure gradient in the annular chamber due to the unilateral release of the closing fluid will have no effect on the sliding valve.

But to prevent the closing chamber from emptying more slowly than in a drum of the prior art, the annular passage or plurality of passages, as the case may be, must have at least the same total cross section as the release passage in the prior-art design. If one sets out from a drum of the prior art, the cross-section of the annular passage or plurality of passages is to be dimensioned accordingly and the release passage leading to the release valve must be made larger. This enlargement of the release passage without the drum construction of the invention would have the opposite effect, namely a greater distortion of the free liquid level in the closing chamber.

Thus, the invention is directed to a centrifugal separator comprising a rotatably mounted separator drum having at least one sludge discharge passageway disposed at the radially outward periphery of the drum; a piston valve disposed within the drum extending from adjacent the drum axis to adjacent the radially outward periphery of the drum, and being movable vertically to open and close the sludge discharge passagewqy(s) for desludging; a closing chamber in the drum disposed outwardly of the piston valve extending from adjacent the axis of the drum to adjacent the radially outward periphery thereof, defined in part by the axially outward side of the piston, for receiving and discharging control fluid for, respectively, forcing the piston valve to the closed position and relieving force initiating the moving of the valve to its open position; a release passageway communicating with a radially outwardly disposed portion of the control chamber for receiving control fluid from the control chamber for discharge thereof from the drum; and a release valve in the release passage for closing the passage for holding control fluid in the control chamber and opening the passage for discharge of control fluid from the control chamber. According to the invention, the separator is provided with an annular chamber in the drum concentric with the drum axis and interposed between the control chamber and the release passage for receiving control fluid from a periphery portion of the control chamber and conveying the control fluid to the release passage. Means are provided defining an annular passage or a plurality of circumferentially spaced passages between said peripheral portion of the control chamber and the annular chamber. The construction is such that with the release valve open, control fluid leaves the control chamber through said annular passage or through said plurality of spaced passages and the level of the control fluid is maintained concentric with the drum axis as the level in the control chamber moves radially outwardly so that tilting of the drum during emptying of the control chamber is prevented.

An embodiment of the invention is shown in the drawing.

Figure 2:
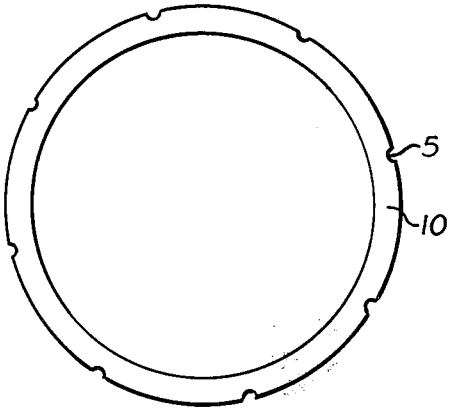

FIG. 1 is a partial cross section of the drum of the invention, wherein a plurality of spaced passages are used and FIG. 2 is a top view of the ring to be inserted into a groove in the stationary drum portion, on a reduced scale.

The separator comprises a separator drum 14 which is rotatably mounted and has at least one sludge discharge passageway 15. The piston valve or sliding valve 1 is guided on its exterior on the stationary (with respect to the operating movement of the valve) drum portion 2 and is acted upon from above by the pressure of the drum charge and from below by the pressure of the closing fluid in the closing chamber 3. The closing chamber 3 is defined in part by the axially outward side 16 of the piston valve 1. In the area of the greatest diameter of the closing chamber 3, the adjacent stationary drum portion 2 is provided with an annular chamber 4, which communicates with the closing chamber 3 at the radially outermost end through a plurality of uniformly, circumferentially spaced passages 5, and from which the release passage 7, which includes the release valve 6, begins.

With the closing chamber 3 filled and the release valve 6 closed, the sliding valve 1 is in the closed position and lies tightly against the sealing ring 8 in the opposite drum portion 9. Through a plurality of passages 5 formed by peripheral notches in ring 19 (FIG. 2), the annular chamber 4 and the release passage 7, up to the release valve 6, have also filled with control fluid.

After the release valve 6 has been opened by feeding a control fluid through line 11, the control or closing fluid located beneath the ring 10 is more rapidly discharged through the release passage composed of passage 7, valve 6, and discharge opening 13 than it flows into the annular chamber 4 through the plurality of passages 5 from the closing chamber 3.

Since the emptying of the closing chamber takes place over virtually the entire circumference, tilting of the sliding valve is no longer possible.

While the construction of the invention is especially effective where as is usual, there is but one release valve 6, it can be used in a drum having more than one release valve as it would compensate for any non-uniformity in the operation of the release valves.

What is claimed is:

1. In a centrifugal separator comprising a. a rotatably mounted separator drum having at least one sludge discharge passageway disposed at the radially outward periphery of the drum, b. a piston valve disposed within the drum extending from adjacent the drum axis to adjacent the radially outward periphery of the drum, and being movable vertically to open and close the sludge discharge passageway(s) for desludging, c. a closing chamber in the drum disposed outwardly of the piston valve extending from adjacent the axis of the drum to adjacent the radially outward periphery thereof, defined in part by the axially outward side of the piston valve, for receiving and discharging control fluid for, respectively, forcing the piston valve to the closed position and relieving force initiating the moving of the valve to its open position, d. a release passage communicating with a radially outwardly disposed portion of the control chamber for receiving control fluid from the control chamber for discharge thereof from the drum, e. a release valve in the release passage for closing the passage for holding control fluid in the control chamber and opening the passage for discharge of control fluid from the control chamber, the improvement which comprises:

f. an annular chamber in the drum concentric with the drum axis and interposed between the closing chamber and the release passage for receiving control fluid from a peripheral portion of the control chamber and conveying the control fluid to the release passage, passageway means between said peripheral portion of the control chamber and the annular chamber such that with the release valve open, control fluid leaves the closing chamber through said passageway means so that the level of the control fluid is maintained concentric with the drum axis as the level in the control chamber moves radially outwardly so that tilting of the piston valve during emptying of the control chamber is prevented.

2. Centrifugal separator according to claim 1, there being a plurality of circumferentially spaced passages between the control chamber and the annular chamber, the spaced passages being uniformly spaced.

3. Centrifugal separator according to claim 1, wherein said passageway means is a ring interposed between the annular chamber and the closing chamber, which together with the drum defines openings which form said plurality of spaced passages.

4. Centrifugal separator according to claim 1, there being only one release valve.

5. Centrifugal separator according to claim 1, the cross sectional flow areas of said annular passage or said plurality of spaced passages, said annular chamber, and said release passage being such that, with the release valve closed and the closing chamber, annular chamber, and release passage, up to the release valve, filled with control fluid, when the release valve opens, control fluid discharges from the annular chamber and release passage, more rapidly than it discharges through the annular passage or plurality of spaced passages.

6. Centrifugal separator according to claim 4, the drum including a chamber in which the separation takes place, the piston valve defining part of the chamber so that in operation the pressure of the drum contents tends to shift the piston valve to the closed position.

7. Centrifugal separator according to claim 1, the drum including a chamber in which the separation takes place, the piston valve defining part of the chamber so that in operation the pressure of the drum contents tends to shift the piston valve to the closed position.

* * * * *